US005308653A

United States Patent [19]

Rondy

[11] Patent Number: 5,308,653

[45] Date of Patent: May 3, 1994

[54] METHOD FOR COLORING WOOD CHIPS USING A SCREW CONVEYOR

[75] Inventor: Greg Rondy, Barberton, Ohio

[73] Assignee: Kurtz Bros., Inc., Cuyahoga Hts., Ohio

[21] Appl. No.: 997,891

[22] Filed: Dec. 29, 1992

Related U.S. Application Data

[63] Continuation-in-part of Ser. No. 749,141, Aug. 23, 1991, Pat. No. 5,192,587.

[51] Int. Cl.[5] ..... B05D 7/06

[52] U.S. Cl. ..... 427/212; 427/242; 427/440; 118/303; 118/417

[58] Field of Search ..... 427/212, 242, 440; 118/417, 303

[56] References Cited

U.S. PATENT DOCUMENTS

| | | | |
|---|---|---|---|
| 3,734,777 | 5/1973 | Bratschitsch | 118/303 |
| 3,968,771 | 7/1976 | Walgenbach et al. | 118/303 |
| 4,067,140 | 1/1978 | Thomas | 47/9 |
| 4,079,696 | 3/1978 | Weber | 118/417 |
| 4,337,720 | 7/1982 | Hager | 427/440 |
| 4,491,504 | 1/1985 | Engall | 162/237 |
| 4,542,041 | 9/1985 | McClellan et al. | 118/303 |
| 4,586,459 | 5/1986 | Schultz | 118/417 |
| 4,788,790 | 12/1988 | Zeager | 47/9 |
| 4,794,022 | 12/1988 | Johnson et al. | 118/303 |
| 4,932,156 | 6/1990 | Underwood | 47/9 |
| 4,987,850 | 1/1991 | McCracken | 118/303 |
| 5,116,634 | 5/1992 | Havens et al. | 118/303 |

FOREIGN PATENT DOCUMENTS

| | | | |
|---|---|---|---|
| 438531 | 1/1975 | U.S.S.R. | 118/417 |
| 617083 | 7/1978 | U.S.S.R. | 118/426 |
| 665836 | 6/1979 | U.S.S.R. | 118/303 |
| 725595 | 4/1980 | U.S.S.R. | 118/303 |

*Primary Examiner*—Terry J. Owens

*Attorney, Agent, or Firm*—Oldham, Oldham & Wilson Co.

[57] ABSTRACT

Comminuted wood is converted to a colored wood product useful as a mulch by feeding the comminuted wood into the lower end of an angularly upward positioned screw conveyor having an internal auger. The comminuted wood is contacted in the lower end of the conveyor by a liquid color-imparting agent, preferably an aqueous solution containing iron oxide pigment, carbon black pigment or a mixture of both pigments. After contacting, rotation of the auger draws the moist colored wood product towards the upper end, permitting runoff of excess liquid agent, which returns by gravity to the basin for further contacting with newly-fed comminuted wood. Colored wood product discharges through a chute at the upper end of the conveyor for further drying, if necessary.

12 Claims, 4 Drawing Sheets

METHOD FOR COLORING WOOD CHIPS USING A SCREW CONVEYOR

This is a continuation-in-part of copending application Ser. No. 07/749,141 filed on Aug. 23, 1991 now U.S. Pat. No. 5,192,587.

This invention relates to method for applying a coloring agent to ground wood material to make a product having aesthetical pleasing appearance. Even more particularly, the present invention relates to a method for contacting uncolored ground wood material in an aqueous solution containing a coloring agent and coating the ground wood product with the coloring agent by use of a screw auger. Even more particularly, the present invention relates to a method of using ground wood product, particularly wood products derived from used lumber, thereby eliminating the disposal problem of such lumber.

BACKGROUND ART

It is well known to utilize dark colored ground wood product as a mulch material in gardening applications. In such applications, the coloration of the wood chip material is critical to the marketability of the product. Particularly, wood product prepared from the bark of certain trees. The distinctive color of such mulches, typically into red and orange colors range in spectrum from a near black shade through the brown range and into red and orange colors. At least as important as the exact color is a uniformity of color in the mulch. A blonde colored mulch seems to lack the attraction of other colors of material for gardening applications.

Although the preferable material in a mulch may be the bark, it is clear that the supply of such mulch is limited and generally not expandable without expanding the amount of wood being felled. At the same time, however, there is a significant amount of lumber, particularly light colored lumber as used in producing pallets, that is disposed of yearly. If this material were capable of being converted into an aesthetically pleasing mulch material that would compete favorably with the bark mulches on the market, the inherent problems of land filling with this material could be avoided. Additionally, the supply of available light colored lumber of this sort is at least adequate to meet the demand that would be made for the preferred mulch material. In this way, an additional supply of a desired product is brought to the market without increasing the destruction of forest lands and an ecologically sound disposition of the material, otherwise landfilled, is also achieved.

It is also known that surface oxidation of light colored lumber will occur naturally, resulting in a darker colored material. It is not generally feasible to use this natural darkening through oxidation, however, to prepare a dark colored mulch material. This is because the natural oxidation is subject to variation among the wood, so that achievement of a uniform color is certainly not at all probable. Additionally, it is desirable to move the wood through a processing facility in a rapid fashion so that no piles of ground wood are sitting around waiting for the natural oxidation of the surfaces to occur. It is well known that, under proper weather conditions, a ground wood pile can spontaneously combust due to the heat generated internally to the pile by the oxidation process.

SUMMARY OF THE INVENTION

It is, therefore, a first object of the invention to provide a method and apparatus for converting a ground wood stock into colored wood mulch material.

It is a second object of the invention to provide an additional source for colored mulch material that is equivalent in the marketplace to bark mulch products including cypress, cedar, pine and eucalyptus.

It is a further object of the invention to provide a method of disposing of used lumber without the necessity of disposition in a land fill.

These and further objects of the invention are provided by a method and a device for preparing a colored wood product, useful as mulch.

The method comprises feeding comminuted wood into an angularly upward positioned screw conveyor with a lower end and an upper end. The screw conveyor has a helical auger disposed axially within a generally closed cylindrical channel with a feed port near the lower end and a discharge port near the upper end. The helical auger is capable of being rotated by a drive means, and the angularly positioned lower end of the cylindrical channel effectively aids in the mixing action. The comminuted wood is contacted with an aqueous color-imparting solution containing at least one color-imparting agent therein.

In one embodiment said contact occurs in the basin portion of the closed channel for sufficient time to disperse the color-imparting solution upon the surfaces of said comminuted wood, effectively forming a wet colored wood product. By rotating the auger so that the wet colored wood product is drawn upwardly out of the basin and toward the upper end, excess color-imparting solution drains away from the wet colored wood product and returns by gravity to the basin portion, effectively drying the wet colored wood product into a moist colored wood product, which is discharged from the screw conveyor via said discharge port. Further drying of the moist colored wood product may be provided.

This method is preferably conducted in a continuous manner by feeding the comminuted wood continuously into the lower end of the screw conveyor, continuously monitoring the liquid level in the basin, and adding additional amounts of color-imparting solution. To monitor and control the basin liquid level, an auxiliary tank is provided in communication with the basin portion such that a change in level in the basin portion causes a directly proportional change in the auxiliary tank, a means for sensing the level of the auxiliary tank and providing a signal to a pump means to inject the make-up aqueous color-imparting solution is provided. The pump means is in communication with a source of said make-up aqueous color-imparting solution.

In a second embodiment, the comminuted wood product is contacted at the channel inlet with an amount of aqueous color imparting solution matched to the intake rate of the wood product and mixed as propelled through the channel by the auger. This embodiment greatly reduces the excess color imparting solution mixed with the wood product. However, any excess is still permitted to drain back to the lower end of the channel.

In both preferred embodiments, the make-up aqueous color-imparting solution is prepared by injecting a sufficient quantity of a color-imparting concentrate to a sufficient quantity of water. The preferred aqueous color-imparting solution comprises a mixture of iron oxide pigment in liquid suspension and carbon black pigment in liquid suspension, wherein the iron oxide mixture ranges from about 5 percent by volume to about 100 percent by volume and the carbon black mixture ranges from about 5 percent by volume to about 100 percent by volume.

DETAILED DESCRIPTION OF THE DRAWINGS AND THE PREFERRED EMBODIMENT

Figure 1:
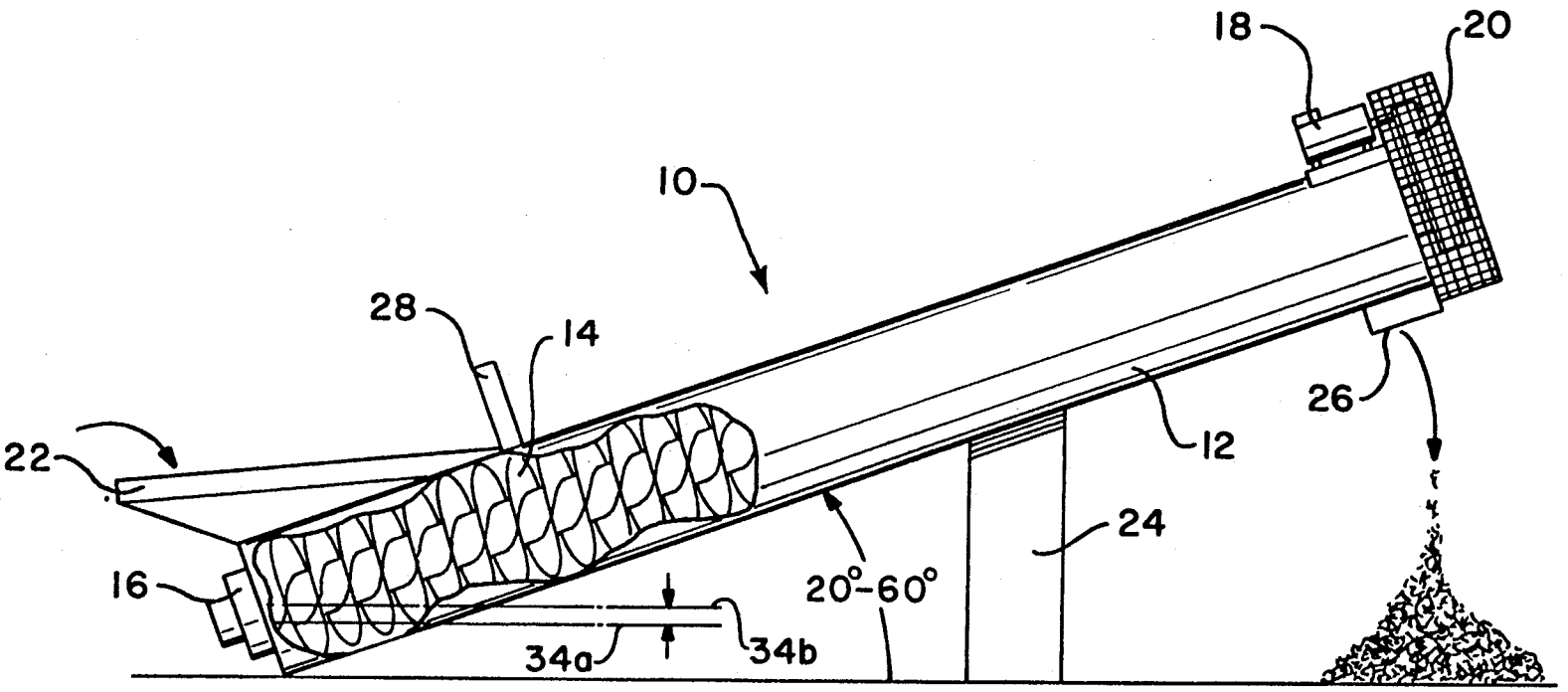
FIG. 1 is a partially broken away side elevational view showing the apparatus of the invention.

As used in this application for patent, the term "mulch" refers to leaves, straw or other loose material spread on the ground around plants to prevent evaporation of water from soil, freezing of roots, and the like. A commonly used and certainly preferred source of mulch for landscaping purposes is a chipped product produced by comminution of bark products from trees, particularly dark colored trees and, even more particularly, trees possessing an aromatic wood bark, such as the bark of the pine, cedar or other trees, especially the aromatic woods.

As used in this application for patent, the term "wood mulch" particularly relates to the mulch that is prepared from woody material rather than leaves. The term "wood mulch" particularly is used in this application to refer to a product that is not only prepared from such woody material, but is typically irregular in shape with a thickness of up to 2 inches, a width of up to 4 inches and a length of up to 4 inches or so. When viewed parallel to the shortest dimension, the typical bark mulch product is seen to have elliptical to circular cross section. The typical bark mulch has a color which varies from a reddish-orange to a dark brown hue.

As used in this application for patent, the term "wood" means the hard fibrous substance found beneath the bark in the stems, branches and roots of trees and shrubs. This material is referred to as "wood" regardless of whether it is unconverted from its natural state, as in the case of a tree trunk, or whether it has been converted into a wood product such as a plank, stave, board, or other piece of lumber.

The process of the present invention is generally practiced by starting with wood as defined hereinabove. This wood, in whatever form, may be passed through a comminuting machine such as is well known in the art, resulting in a comminuted or chipped material that has a size consist as determined by the operating parameters of the comminuting machine. The variety of sources of such wood allows a great deal of discretion to the operator of the process. Such an operator may choose from wood from a wide spectrum of sources ranging from excess branches and material pared from tree trimmings to lumber that has had previous use, such as in discarded pallets, used barrel staves and the like. It would appear that there is some preference in the coloring process for wood that is not "green", i.e., the preferred wood has been dried or dewatered significantly from its naturally occurring state. This aging of the wood can be achieved by a variety of processes, all of them within the grasp of the practitioner of this art. The preferable material is a dry wood having 30 percent moisture or less that is ground so that it passes through a 1¾ inch screen. Green wood, i.e. wood having 30 to 80 percent moisture content may be used for the process and the process has been successfully used on wood ranging from virtually powdered material to sticks of 1¾ inch×1¾ inch×8 inch. In referring to moisture content, we refer to the moisture retained in the wood from the original cutting rather than moisture absorbed during storage or grinding procedure.

As practiced, the first preferred embodiment present invention utilizes an auger screw such as the 36 inch×26 foot Fine Material Screw produced by Eagle Crusher Co. of Galion, Ohio. A screw of this type comprises a generally cylindrical channel with a helical auger positioned axially inside. the auger is connected to a motor means so that rotation of the screw may be effected. When the motor device is positioned in angular relationship with the ground so that there is a higher end and a lower end of the device, the lower end thereof will effectively form a basin wherein a coloring solution may be added. Comminuted, uncolored wood may be added to the basin for contacting with the coloring solution. By activating the motor means and causing the auger screw to rotate in a first direction, the screw device may be used as an Archimedean screw, i.e. a device for raising liquid or loose material such as sand, cement, or the like from a lower level to a higher level by rotation of the screw. If the auger screw were positioned in the cylindrical channel in a relatively tight and waterproof relationship, the coloring liquid in the basin would be simultaneously lifted from the basin to the upper end of the screw device. However, if the relationship between the auger screw end and the channel is somewhat looser, the peripheral portion of the auger screw in conjunction with the channel will permit the flow of excess coloring liquid back into the basin as it disengages itself from the moistened, and now colored, wood that has been drawn upwardly by the action of the screw. As the wood reaches the upper end of the screw device, an aperture on the lower surface of the channel permits the discharge of the colored wood product from the channel and the screw device.

In operating the device for coloring a wood product, a steady feed of material into the basin is recommended to achieve the most economical coating.

The exact parameters for operating the screw device will, of course, depend upon the various conditions being used, including, but not limited to, the moisture content of the wood, the strength of the coloring material solution and ambient conditions. However, it is noted that a 20 rpm speed on the specific Fine Material Screw cited above will easily process 50 cu. yds. of material per hour when driven with a 10 hp motor through a reduced drive gear box. Increasing the rpm will increase the productivity of the screw device but the excessive loading of the screw will tend to impede the drainage of colorant away from the material and excessive speed will result in reduced contact time and insufficient color in the material. Other variables noted to affect the operation of the screw device include the size of the individual particles, the percent of fine particles and the type of wood in use.

An important feature of the screw device is the implementation of a liquid level control system to control operation of the coloring basin. This is best achieved by the simple addition of an auxiliary tank in communication with the main coloring basin, wherein an electric float switch monitors the current level in the main coloring basin and activates an electric water valve on an "on/off" basis to allow makeup water to be added into the basin.

The inventor has determined when the Eagle 36 inch×26 foot Fine Material Screw is operated at 20 rpm and is fed with material comprising 75 percent coarse (i.e. material passing through a 1¾ inch screen) and 25 percent fine (i.e. material passing through a ⅜ inch screen) approximately 20 to 30 gallons of water will be required per cubic yard of wood chips when the wood chips are added at a steady rate. It is preferred in the addition of water that the colorant material is directly injected into the water prior to the entry of the water into the colorant basin. A variety of chemical injection pumps are well known and would be suitably adapted to this purpose. In the preferred embodiment presently known to the inventor, a discharge pump is the best because it will pass chunks of pigment or small wood chips.

The color imparting agent may be selected from one of a variety of colorant agents. The inventor's preferred colorant material is a commercially available blend that contains mixture of an iron oxide pigment with a dispersion of carbon black.

With reference to the embodiment of the invention illustrated in FIG. 1 of the drawings, the numeral 10 indicates generally the apparatus of the invention which comprises a long cylindrical housing 12, which receives a rotatable auger or screw 14, such screw or auger being rotatably mounted at each end in bearing units with numeral 16 showing on the left end and the bearing unit mounted inside and not shown on the right or upper end. The auger 14 is rotated by means of motor 18 driving a belt 20 which connects to the protruding end of the auger. Any type of typical mechanism to achieve the desired rotation of the auger at a desired speed would meet the objects of the invention.

An input chute for materials is indicated by numeral 22, and normally it is contemplated that the chips will come directly from a chipper and the unit will function on a continuous basis as chipped wood material comes out of the chipper unit. The input chute feeds down into the auger and provides a continuous amount of chipped material dropping down onto the auger itself. The unit 10 is mounted in an upwardly inclined position by a support 24 which can be adjustably positioned so that the upward tilt of the housing 12 would be between 20° to about 60°, but preferably at about 30°–40° to provide a continuous upward movement of the wood chips from the coloring liquid at the lower left end, and then progressing upwardly and drying while dripping back any excess fluids to then ultimately be discharged from an output chute 26 at the upper right end of the cylindrical cover 12. A baffle 28 may be provided at the front edge of the input chute so that any material flying out will be deflected downwardly into the auger fluid level arrangement.

FIG. 1 also indicates that the top fluid level will be at about the central position of the auger 14 which is contemplated to be approximately 36 inches in diameter and 26 feet long and identified as a substantially "fine material screw". The lower fluid level indicator shows how the level will drop and be sensed by the fluid sensing level to add more liquid, as described with respect to FIG. 2 hereinafter.

Figure 2:
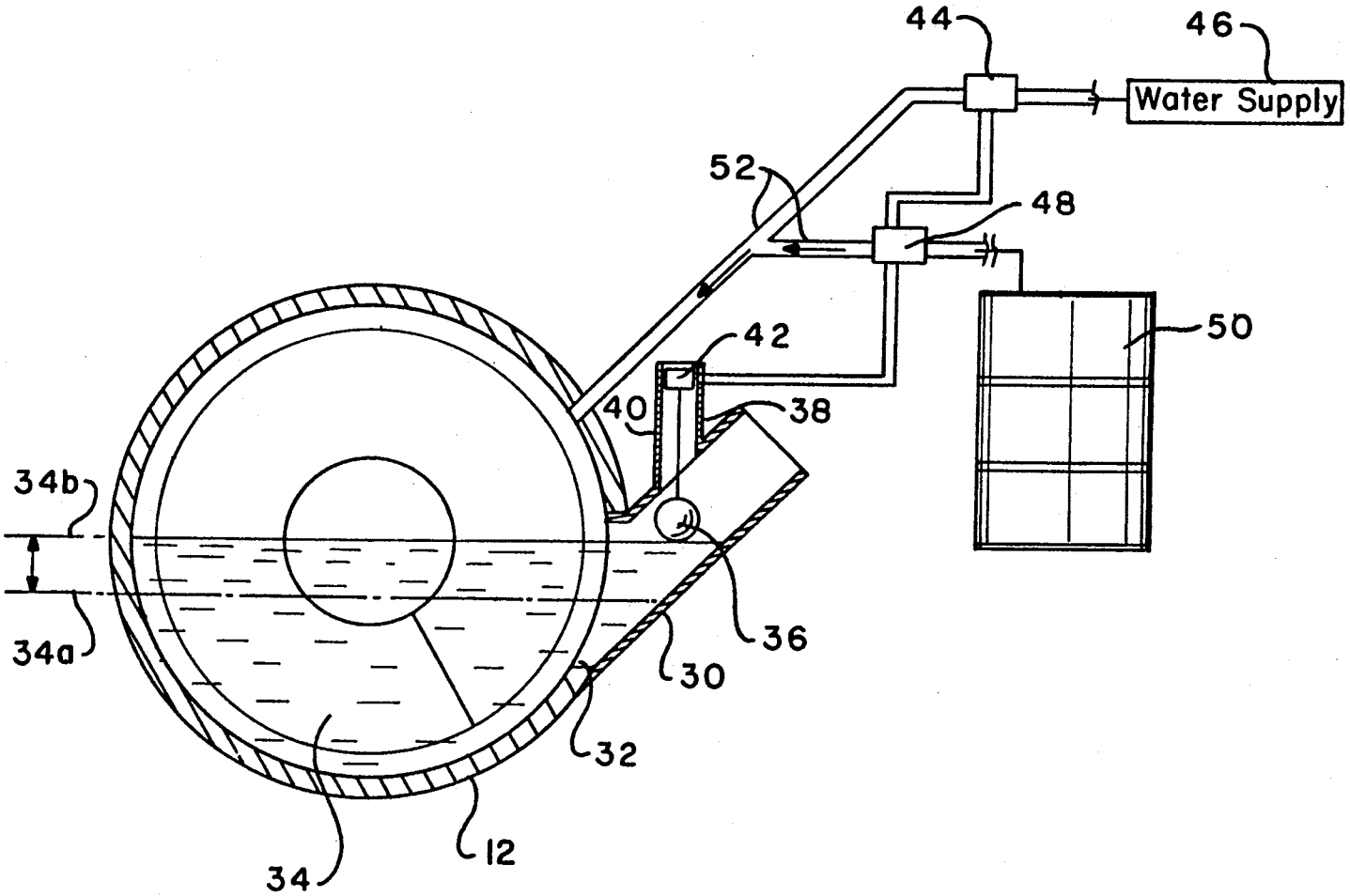
FIG. 2 is an end cross-sectional view of the auger screw showing the water level sensing system and schematically illustrating the control to the mixing of the color supply and the water supply to add coloring liquid to the mixing achieved by the auger in the receiving bin.

Looking at FIG. 2, the fluid level is determined by providing a fluid level sensing pipe 30 projecting at a about a 45° angle off the housing 12, which would be adjacent the bottom end of the housing or at the very left lower corner of the housing as seen in FIG. 1, but pipe 30 is not shown because of the broken away relationship of the drawing. In any event, it is contemplated that an approximately 8 inch diameter pipe will fit into and communicate then with the elliptically shaped opening 32 in the wall of housing 12 allowing the liquid indicated by numeral 34 to communicate freely up into the pipe 30. A buoyant ball or float 36 connected to rod 38 is adapted to move up and down in connecting pipe 40 thus allowing float 36 to move vertically up and down showing the level of the fluid 34. This rod 38 cooperates with a switch 42 to actuate the liquid valve 44 from water supply 46 as well as the color pump 48 to draw colorant from the color supply drum 50 when the float 36 drops to a predetermined level indicated as **34*a*, this being the lower operating level, with fluid then directed in their respective pipes as shown by arrows 52 to fill the fluid level up to 34*b*, at which time switch 42 disengages both the valve 44 and the pump 48, until the float 36 drops to level 34*a* again. It has been found that this arrangement of the large pipe 30 eliminates any problem with wood chips causing a disruption or any malfunction of the float 36, since its impossible for any chips to get up into and foul up the upward vertical reciprocal motion of rod 38 as actuated by float 36**. In this way no screens or any other means of preventing chips or any of the fines from disrupting the sensing of the water level are needed.

Figure 3:
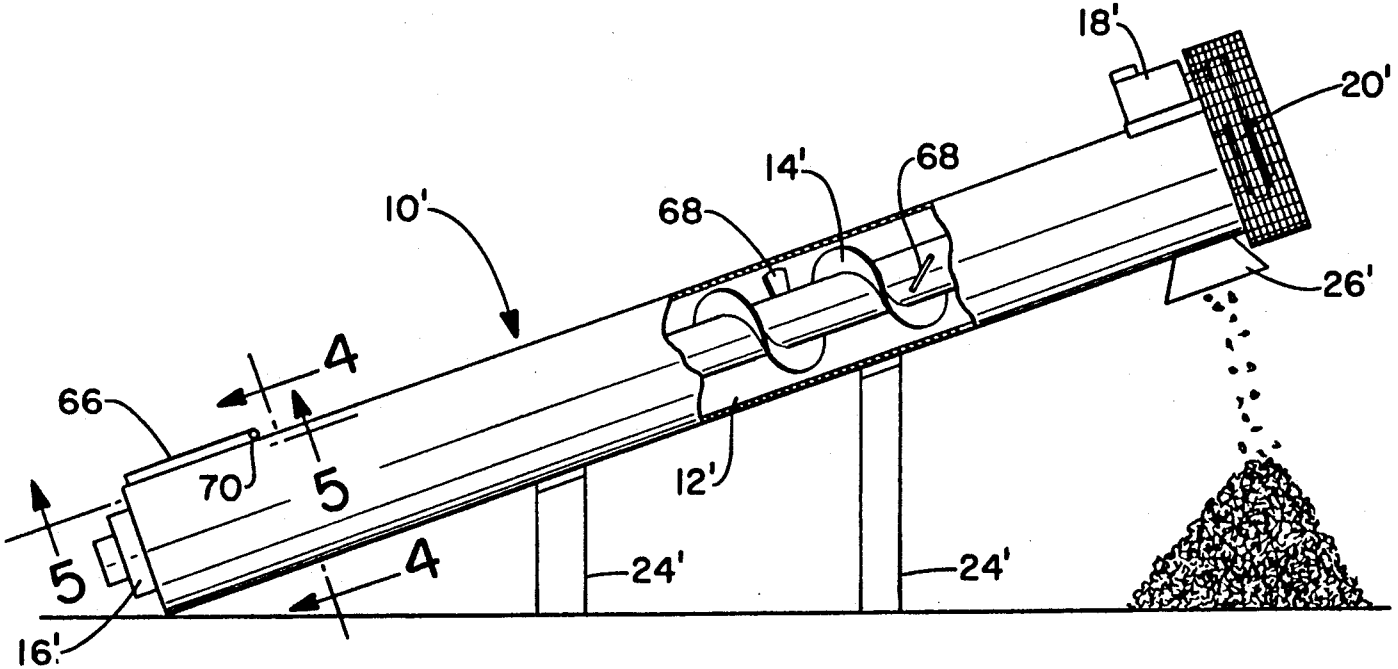
FIG. 3 is a side elevational view of a second embodiment of the present invention containing a partial cutaway of the cylinder.
Figure 4:
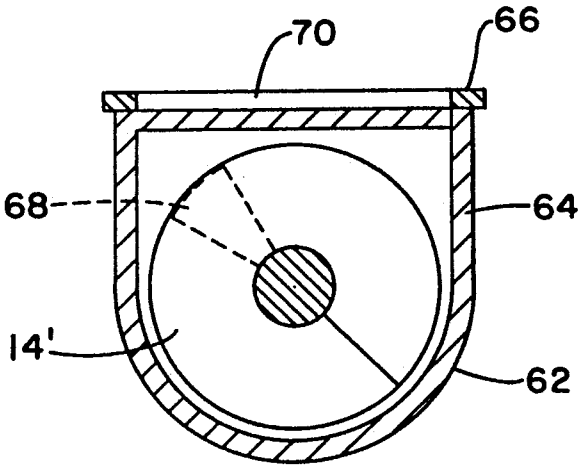
FIG. 4 is a transverse cross sectional view taken through line 4—4 of FIG. 3.
Figure 5:
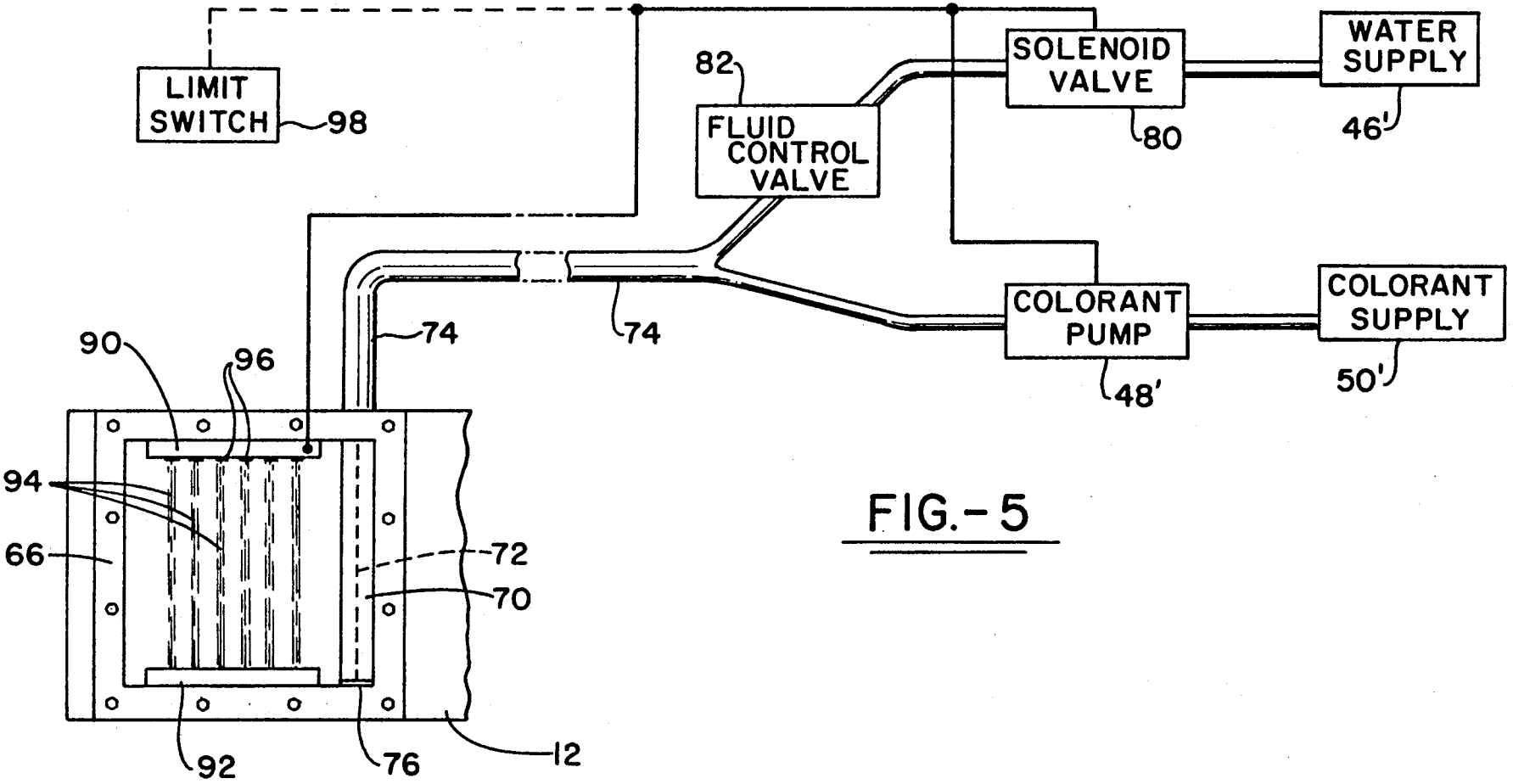
FIG. 5 is a cross sectional view taken through line 5—5 of FIG. 3 and a schematic view illustrating the process of combining the color and water supplies and the introduction of the resulting solution into the apparatus.

Now with reference to the embodiment of the invention illustrated in FIGS. 3–5, reference numeral 10' illustrates the apparatus of the second preferred embodiment of the present invention, similar in many respects to the first preferred embodiment and comprising a long closed housing 12' which receives a rotatably mounted auger or screw 14'. As with the embodiment illustrated in FIGS. 1–2 auger 14' is rotated by means of a motor 18' driving a belt 20', located at the inclined end of housing 12'. Each end of auger is journaled in a bearing unit 16'.

As best shown in FIG. 4 housing 12' comprises a U-shaped channel 62 to which a cover 64 is attached and sealed along their common edges. A feedport or input chute 66 is formed in the first end of housing 12' to receive uncolored wood product and introduce the wood product to auger 14'.

A preferred auger 14' is contemplated as approximately 24 inches in diameter and 27 feet in length. The preferred auger 14' has a 24 inch pitch and further includes mixing paddles 68 extending radially outward from auger 14' at intervals of 1 and ¼ pitch. Mixing paddles 68 are oriented counter to the pitch of auger 14' in order to cause maximal agitation of the wood product with the colorant.

A metered colorant solution for the coloring of the wood product is supplied via a continuous feed supply system to colorant nozzle 70. In the preferred embodiment nozzle 70 comprises a length of pipe in fluid connection with the supply pipe 74 and having a cap 76 at the opposite end. Nozzle 70 substantially transverses opening of input chute 66 as shown in FIG. 3. Nozzle 70 further comprises an elongated axial slit 72 formed along a substantial portion of its length and in communication with the interior of housing 12'. The inventor has found that with relatively low line pressure a slit of approximately ⅛ inch is optimal to create a thin wall of water falling along the length of slit 72 and onto the wood product following its entry into housing 12' from input chute 66. While a single nozzle 70 is disclosed, it is appreciated that a plurality of nozzles could be located at intervals along the length of housing 14', if desired, or that nozzles of various types known in the art could be substituted for that disclosed a nozzle 70.

The introduction of colorant solution onto wood product within the interior of housing 12' is regulated by means of a photoelectric sensor 90 as is well known in the art. The sensor 90 comprises a light source 92 which emits a plurality of light beams 94 across the opening of input chute 66. The beams 94 are detected by one or more sensors 96. These sensors 96 determine the presence of light beams 94 and are interrupted each time wood product passes through input chute 66. The interruption of light beams 94 actuates a solenoid valve 80 to initiate the flow of water from water supply 46' through supply line 74. It is appreciated that other sensor means known in the art may be utilized. A flow control valve 80 may be included along supply line 74 to regulate the flow of water and/or water/colorant mix.

Sensor 90 similarly activates colorant pump 48' to withdraw concentrated liquid dispersion of colorant from colorant supply 50' and introduces a regulated amount of the dispersion into supply line 74. Although many high viscosity diaphram metering pumps may be used a Liquid Metronics Model No. M 141-30HV has been found to be particularly suitable for this application. The resulting colorant solution is communicated to nozzle 70 where it is administered onto the incoming wood product.

In operation, sensor 90 detects incoming wood product and activates colorant pump 48' and solenoid valve 80. As wood product enters input chute 66 it is coated with colorant solution cascading along slit 72 in nozzle 70. As in the previous embodiment, the colorant and wood product are mixed by the rotation of auger 14' and further by the agitation created by the opposed flow mixing paddles 68. As the now colored wood product is further advanced within housing 12' any excess colorant solution is removed and the wood product is permitted to dry. A colored wood product exits housing 12' via a discharge port or exit chute 26'.

The proportion of colorant to wood product is more carefully matched in this second embodiment to reduce the amount of residual colorant solution produced and increase the processing capacity of the unit. An auger mixer as previously described and utilizing at least a 10 horsepower motor, running at 90 rpm speed is easily capable of processing about 70 to 90 cubic yards of 75% course wood product per hour and utilizes approximately 12–18 gallons of water per cubic yard of wood product. However, it should readily be appreciated that these rates and volumes are provided as an example and are not to be construed as limiting. The proportion of colorant solution to wood product is dependent on many factors including but not limited to: type of wood, its moisture content, porosity, particle size of the active colorant ingredient etc. Using this process an evenly colored, but less saturated wood product is created. The use of excessive colorant solution results in an excessively wet wood product while the use of too little colorant solution results in irregularly colored wood product.

Optimum results have been achieved when the wood product is introduced into the auger mixer at a steady, regulated rate. The colorant solution is regulated to correspond to the volume of wood product entering the housing 12'. The apparatus 10' is best operated on a incline ranging from about 5 to 60 degrees, with 20 degrees being currently preferred, although processing in a horizontal plane is operable. The incline aids in the mixing and allows for the recapture of excess colorant solution created due to fluctuating infeed rates of the wood product.

As previously indicated, the currently preferred colorant agents are carbon black and iron oxide dispersed alone or in combination in a volume of water. Currently, these coloring concentrates are injected into water at a rate ranging from about 0.25 to about 10 percent volumes of concentrate per volume of water, with the more preferred rate ranging from about 0.5 to about 0.6%. Binding agents may be employed to aid in the surface adhesion of the colorant of the wood material.

The iron oxide and carbon black alone or in combination will provide a permanent coloration of the chips that should not leach out. It is postulated that when the concentrated colorant dispersion is made using dry colorant with a particle size ranging from 10–50 micrometers, and preferably 25 micrometers, the colorant particles become lodged in the pores of the wood product. It would be possible and, indeed desirable, in some cases to supplement the color imparting agent with other ingredients including binding agents, surfactants or viscosity enhancers. It is further postulated that the binding agents assist in lodging the color imparting agent within the wood pores.

While in accordance with the patent statutes, the best mode and preferred embodiment of the invention have been described, it is to be understood that the invention is not limited thereto, but rather is to be measured by the scope and spirit of the appended claims.

What is claimed is:

1. A method of preparing a colored wood product, useful as mulch, comprising:

a) feeding comminuted wood into a screw conveyor having a first end and a second end, said screw conveyor further having a helical auger disposed axially and in a close fitting relation to the internal surface within a generally closed channel with a feed port near said first end and a discharge port near said second end, said helical auger capable of being rotated by a drive means, wherein the comminuted wood is fed through the feed port into said first end of said conveyor;

b) contacting said comminuted wood with an aqueous color-imparting solution containing at least one color-imparting agent therein for sufficient time to disperse said color-imparting solution upon the surfaces of said comminuted wood to create a colored wood product, said contact occurring at least at said feed port through a feed port nozzle means substantially traversing said feed port and providing a gravity feed sheet of said color imparting solution from a longitudinal slot formed therein:

c) rotating the auger so that said colored wood product is drawn from said first end toward said second end, during which process any excess said color-imparting solution drains away from said colored wood product, effectively drying said colored wood product into a moist colored wood product; and d) discharging said moist colored wood product from said screw conveyor via said discharge chute and further drying said moist colored wood product, if necessary.

2. The method of claim 1 wherein the comminuted wood is fed in a continuous manner into said first end of said screw conveyor.

3. The method of claim 1 wherein said screw conveyor is oriented in an inclined position, said first end situated lower than said second end.

4. The method of claim 1 comprising the further step following step a) of: detecting the presence of comminuted wood at said feed port and initiating contact of said comminuted wood with said color-imparting solution.

5. The method of claim 1 wherein the aqueous color-imparting solution comprises a mixture of iron oxide pigment in liquid suspension and carbon black pigment in liquid suspension, wherein the iron oxide pigment suspension ranges from about 5 percent by volume to about 100 percent by volume and the carbon black pigment suspension ranges from about 100 percent by volume to about 5 percent by volume.

6. A method according to claim 1 wherein the comminuted wood product comprises a 75 percent course material capable of passing through a $1\frac{3}{4}$ inch screen and 25 percent fine material capable of passing through a $\frac{3}{8}$ inch screen.

7. The method of claim 1 wherein at step b) said comminuted wood is contacted with a regulated amount of color-imparting solution so as to limit the introduction of color-imparting solution in excess of the color-imparting solution which can adhere to surfaces of said comminuted wood.

8. The method of claim 1 wherein said auger is in such proximity to the inner wall of said channel that said comminuted wood is drawn toward said second end by rotation by said auger but any excess said solution flows away from said discharge port.

9. The method of claim 4 wherein the step of detecting the presence of comminuted wood and initiating contact of said comminuted wood with said color imparting solution is accomplished by a sensor means.

10. The method of claim 9 wherein said sensor means opens a solenoid valve in fluid contact with said nozzle means.

11. The method of claim 9 wherein said sensor means actuates a pump in fluid contact with said nozzle means.

12. The method of claim 1 comprising the further step following step c) of:

mixing said colored wood product as it is drawn from said first end toward said second end using a plurality of mixing paddles extending radially outward from said auger.

* * * * *